US011078661B2

(12) United States Patent
Canby

(10) Patent No.: US 11,078,661 B2
(45) **Date of Patent: *Aug. 3, 2021**

(54) ROLLING BLOCK RESTRAINT CONNECTOR HAVING AN IMPROVED LINKAGE ASSEMBLY

(71) Applicant: Timothy William Canby, Irvine, CA (US)

(72) Inventor: Timothy William Canby, Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/593,823

(22) Filed: Oct. 4, 2019

(65) Prior Publication Data

US 2021/0102369 A1 Apr. 8, 2021

(51) Int. Cl.
*E04B 1/41* (2006.01)

(52) U.S. Cl.
CPC ..... *E04B 1/40* (2013.01)

(58) Field of Classification Search
CPC ... E04B 1/40; E04B 1/98; E04B 1/985; E04B 1/185; E04H 9/02; E04G 23/0203; E04G 23/0218; Y10T 403/7194; Y10T 403/4602; Y10T 403/7158
USPC ..... 248/235–250
See application file for complete search history.

(56) References Cited

U.S. PATENT DOCUMENTS 949,394 A * 2/1910 Daly ..... E04B 1/2403 403/173
3,178,780 A 4/1965 Booher
3,268,252 A * 8/1966 Rolland ..... E04B 1/58 403/296
3,820,293 A 6/1974 Ohe et al.
(Continued)

FOREIGN PATENT DOCUMENTS

EP 2492408 A1 8/2012
GB 2066892 B 11/1983
(Continued)

OTHER PUBLICATIONS

U.S. Appl. No. 15/629,570, filed Jun. 21, 2017 Non-Final Office Action dated Feb. 12, 2018.
(Continued)

*Primary Examiner* — Paola Agudelo
(74) *Attorney, Agent, or Firm* — Rutan & Tucker, LLP; Kyle M. St. James

(57) ABSTRACT

A rolling block restraint connector for forming a moment resisting connection at a joint intersection between a continuous first structural member and at least a first continuous second structural member that intersects the continuous first structural member is shown. The connector includes a first restraint assembly including (i) a first block, (ii) a second block, and (iii) a first shaft that passes through channels of the first block and the second block, a second restraint assembly including (i) a third block, (ii) a fourth block, and (iii) a second shaft that passes through channels of the third block and the fourth block, a first linkage that couples the first restraint assembly with the second restraint assembly, and a second linkage that couples the first restraint assembly with the second restraint assembly, wherein the first shaft and the second shaft each pass through the first linkage and the second linkage.

18 Claims, 17 Drawing Sheets

(56) References Cited

U.S. PATENT DOCUMENTS

| | | | | |
|---|---|---|---|---|
| 4,379,651 | A * | 4/1983 | Nagashima | E04G 7/26 248/228.5 |
| 4,616,950 | A | 10/1986 | Morris | |
| 5,505,416 | A | 4/1996 | Dodge | |
| 5,813,181 | A * | 9/1998 | Ashton | E04H 9/14 52/291 |
| 6,158,188 | A | 12/2000 | Shahnazarian | |
| 6,609,343 | B1 | 8/2003 | Litten | |
| 6,862,854 | B1 | 3/2005 | Fitzmyers | |
| 6,920,724 | B1 | 7/2005 | Hundley | |
| 7,004,804 | B2 * | 2/2006 | Bernloehr | B63H 20/007 248/642 |
| 7,117,648 | B1 | 10/2006 | Pryor | |
| 7,299,596 | B2 | 11/2007 | Hildreth | |
| 8,065,843 | B2 * | 11/2011 | Timothy | F16G 11/12 52/149 |
| 8,256,737 | B2 * | 9/2012 | Stango | G05G 25/04 248/642 |
| 8,769,887 | B2 | 7/2014 | Proffitt, Jr. | |
| 9,909,300 | B2 | 3/2018 | Miller | |
| 10,113,307 | B1 | 10/2018 | Canby | |
| 10,745,907 | B1 | 8/2020 | Canby | |
| 2010/0232872 | A1 | 9/2010 | Kato | |
| 2010/0293880 | A1 | 11/2010 | Reichartz | |
| 2011/0047925 | A1 | 3/2011 | Gan | |
| 2014/0332659 | A1 | 11/2014 | Tichell Fortea et al. | |
| 2016/0190976 | A1 * | 6/2016 | Corio | F24S 30/425 361/807 |
| 2017/0268220 | A1 * | 9/2017 | Miller | E04B 1/2403 |
| 2018/0266135 | A1 * | 9/2018 | Agha Beigi | E04B 1/98 |
| 2019/0242112 | A1 * | 8/2019 | LeBlang | E04C 3/32 |
| 2019/0249417 | A1 * | 8/2019 | Dicaire | E04B 1/40 |
| 2019/0257070 | A1 * | 8/2019 | Grosch | E04B 1/40 |

FOREIGN PATENT DOCUMENTS

| | | | |
|---|---|---|---|
| JP | H08-226168 | A | 9/1996 |
| JP | 2003-301596 | A | 10/2003 |
| JP | 2010236197 | A | 10/2010 |
| JP | 4861067 | B2 | 1/2012 |
| WO | 2016/036563 | A1 | 3/2016 |
| WO | 2016051388 | A1 | 4/2016 |

OTHER PUBLICATIONS

U.S. Appl. No. 15/629,570, filed Jun. 21, 2017 Notice of Allowance dated Jul. 11, 2018.

U.S. Appl. No. 16/357,173, filed Mar. 18, 2019 Non-Final Office Action dated Jan. 16, 2020.

U.S. Appl. No. 16/357,173, filed Mar. 18, 2019 Notice of Allowance dated Apr. 14, 2020.

PCT/US20/53828 filed Oct. 1, 2020 International Search Report and Written Opinion dated Jan. 8, 2021.

* cited by examiner

Fig. 13
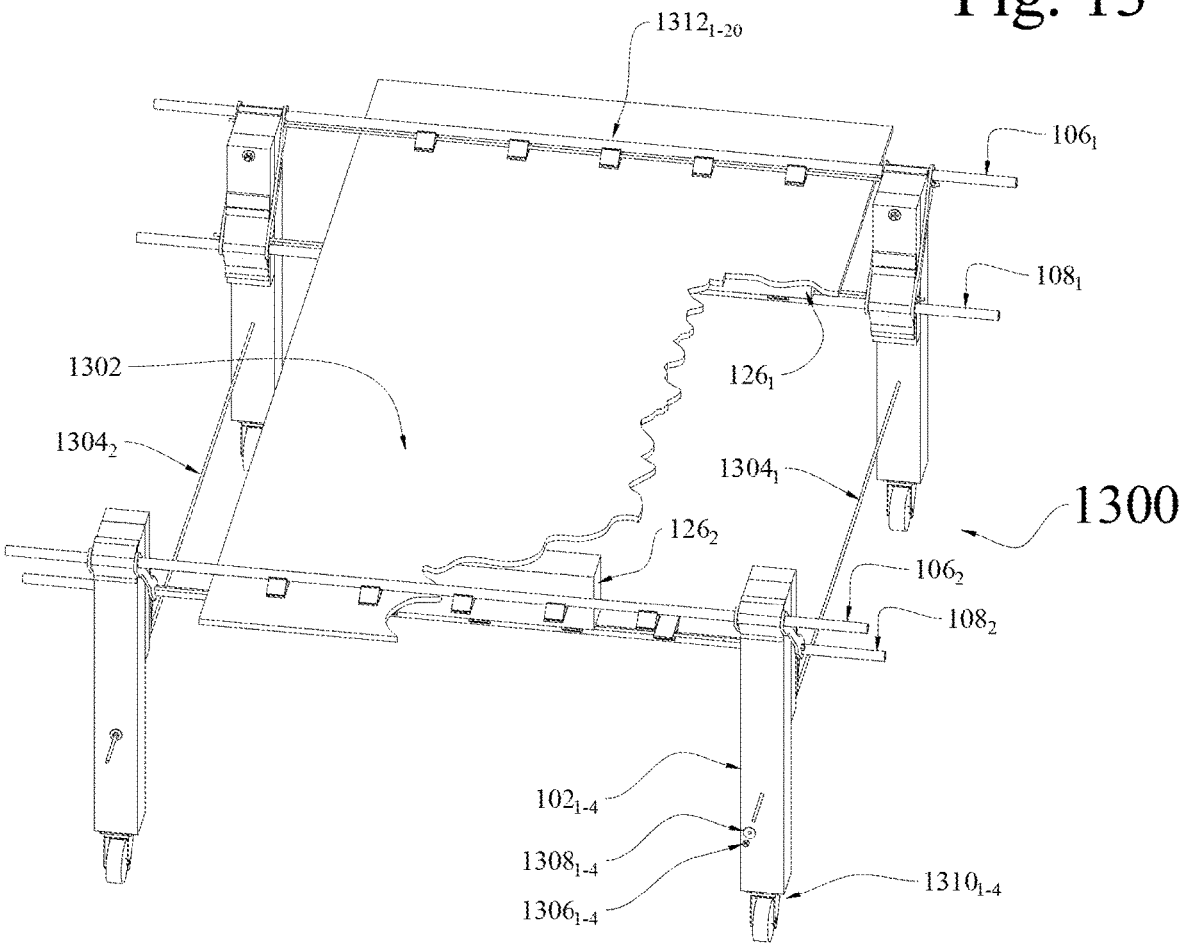
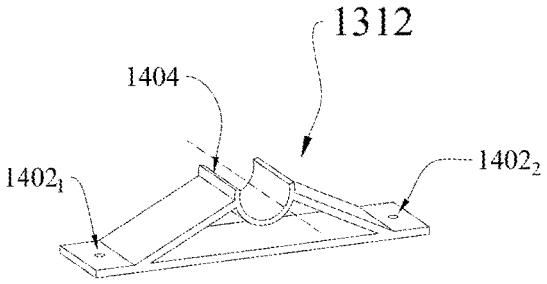
Fig. 14

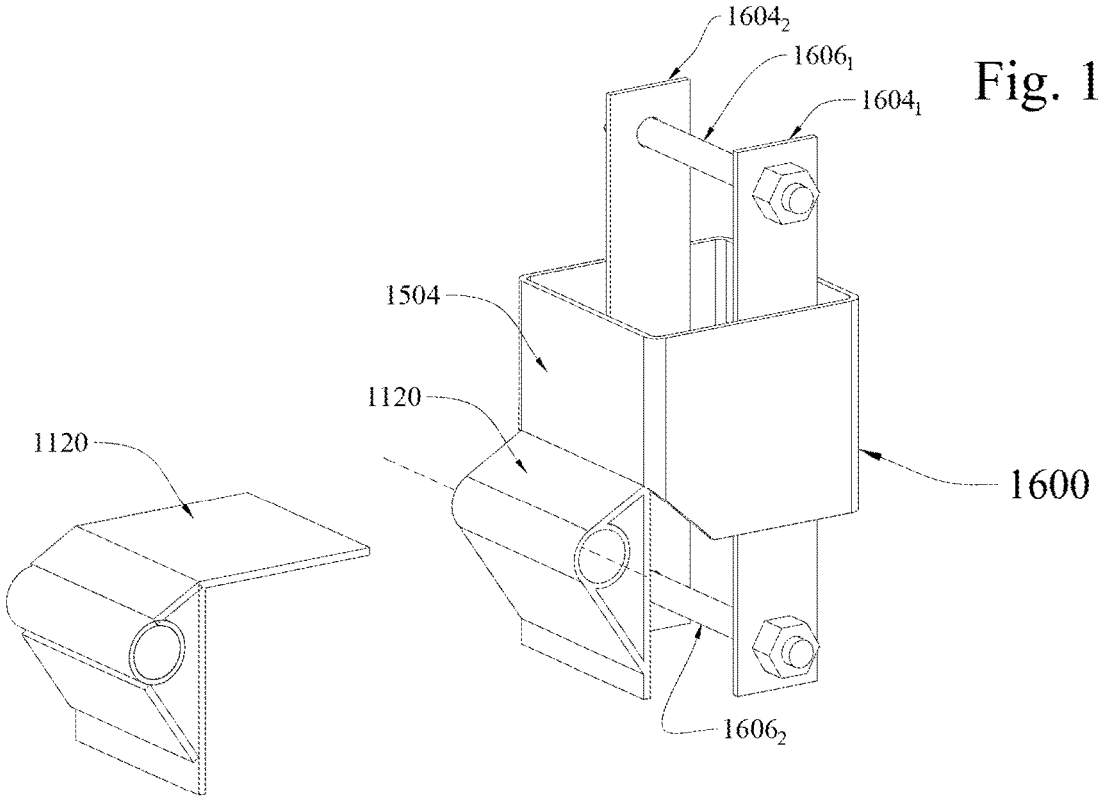
Fig. 16A
Fig. 16B
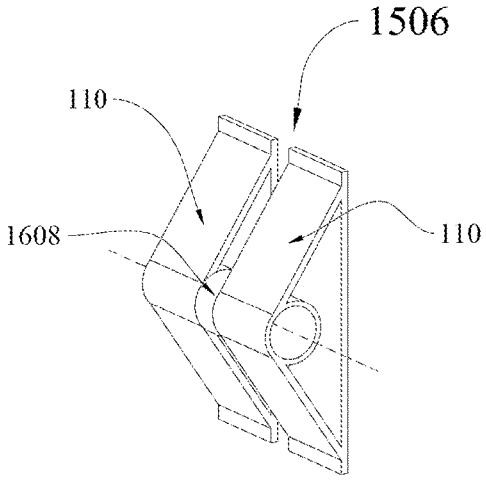

ROLLING BLOCK RESTRAINT CONNECTOR HAVING AN IMPROVED LINKAGE ASSEMBLY

FIELD

The present invention relates to connectors used for making connections by external restraint of members at joints where structural framing members cross and in particular, a joint which resists relative rotation of the members at the connection, such connection being a fixed end moment (FEM) connection which allows different structural configurations to be made and has greater load capacity and with less deflection than simply supported connections.

GENERAL BACKGROUND

Connections are formed and made to hold the structural framing members together to build physical structures such as walls, floors, roofs, towers, bridges, toys, and furniture. Various methods are utilized to form and make connections at the joints where structural framing members cross. Rigid moment connection joints made by processes such as welding, bolting or gluing are time consuming, complicated to make and need to be specifically designed on a case by case basis for the specific materials, size and sectional shapes to be joined. A connector that relies on external forces applied to the outside surface of structural members provides a moment resisting rigid connection independent of size, sectional shape and material joined. Such a connection would be highly valued to the general public for use as an element for structural framing and, in particular, for wood member connections.

A connector may be used to form a fixed end moment connection between two crossing structural members. As used herein, a "block" includes a plurality of surfaces with at least one surface conforming to a structural member surface (e.g. beam, column or simply member), and one surface conforming to at least a partial arc angle of an opposed member herein referred to as a shaft. As there is no connection to the shaft it is free to revolve a limited degree of rotation, and, thus such a block may be referred to as a "rolling block restraint" (RBR). Two sets of rolling blocks are mounted on shafts positioned diagonally across from each other at a joint of two crossing structural members. The shafts are held fixed by linkages installed between them. This configuration resists rotation of the members relative to each other in one direction to form a fixed end moment connection and the connector used to provide this type of connection is referred to as a rolling block restraint connector or RBR connector.

Various factors may be considered when selecting a connector for use in a structure. These may include ease of assembly, field installation and equipment needed for erection, number of parts, interchangeability of the parts or common parts, use with standard size materials, compatibility and performance. The connector should be easy to install and adjust for the field conditions encountered, have a range of geometry it can be used for, form a tight connection that does not loosen, endure all the structure loads, vibrations and movements that occur during erection and service. This disclosure addresses these factors disclosing a connector superior to previous designs.

The current state of the art may be improved in several areas as discussed below. First, an eccentric loading occurs using an RBR connector for a two-member joint because the center axis of each joint is offset from each other. This misalignment creates a twisting force due to the uneven shaft forces relative to each other, which tend to force the members away from each other and misalign the shafts. For the linkage having a single rod passing through holes in the shaft, the linkage cannot be clamped against the members to provide transverse restraint to overcome this condition. Thus, the current art does not allow effective lateral clamped joints to be made.

Second, a linkage using multiple threaded rods is difficult to properly adjust. This difficulty together with the twisting problem makes installation unnecessarily complex, increases likelihood of error, which results in a decrease in reliability making embodiments of the current art unsuitable for use.

Third, embodiments of the current art often utilize a pin through the centroid of the crossing members to fix the members in place and provide vertical support. This configuration, weakens members, is difficult to erect, and may cause weakening if adjusted improperly. The invention disclosed herein overcomes the deficiencies of the current art.

BRIEF DESCRIPTION OF THE DRAWINGS

One or more embodiments of the present disclosure are illustrated by way of example and not limitation in the figures of the accompanying drawings, in which like references indicate similar elements.

FIG. 13 shows space structure composed of four columns, connectors and a panel installed between them;

FIG. 14 illustrates a column block or beam block having an opening on a top portion of the sleeve (i.e., shaft channel);

FIGS. 16A-16B illustrate variations of column and beam blocks;

DETAILED DESCRIPTION

Embodiments of the invention are directed to rolling block (RBR) connectors. Some embodiments utilize fixed-length links with adjustable wedge shims and spacers to set angle of member intersection. Additionally, some embodiments of the invention include block shafts that are extended to span between adjacent connectors, which maintains parallel orientation of the shafts and alignment of the members. The use of extended block shafts also allow structures having moment resistant connections perpendicular to the beams to be formed.

Figure 1:
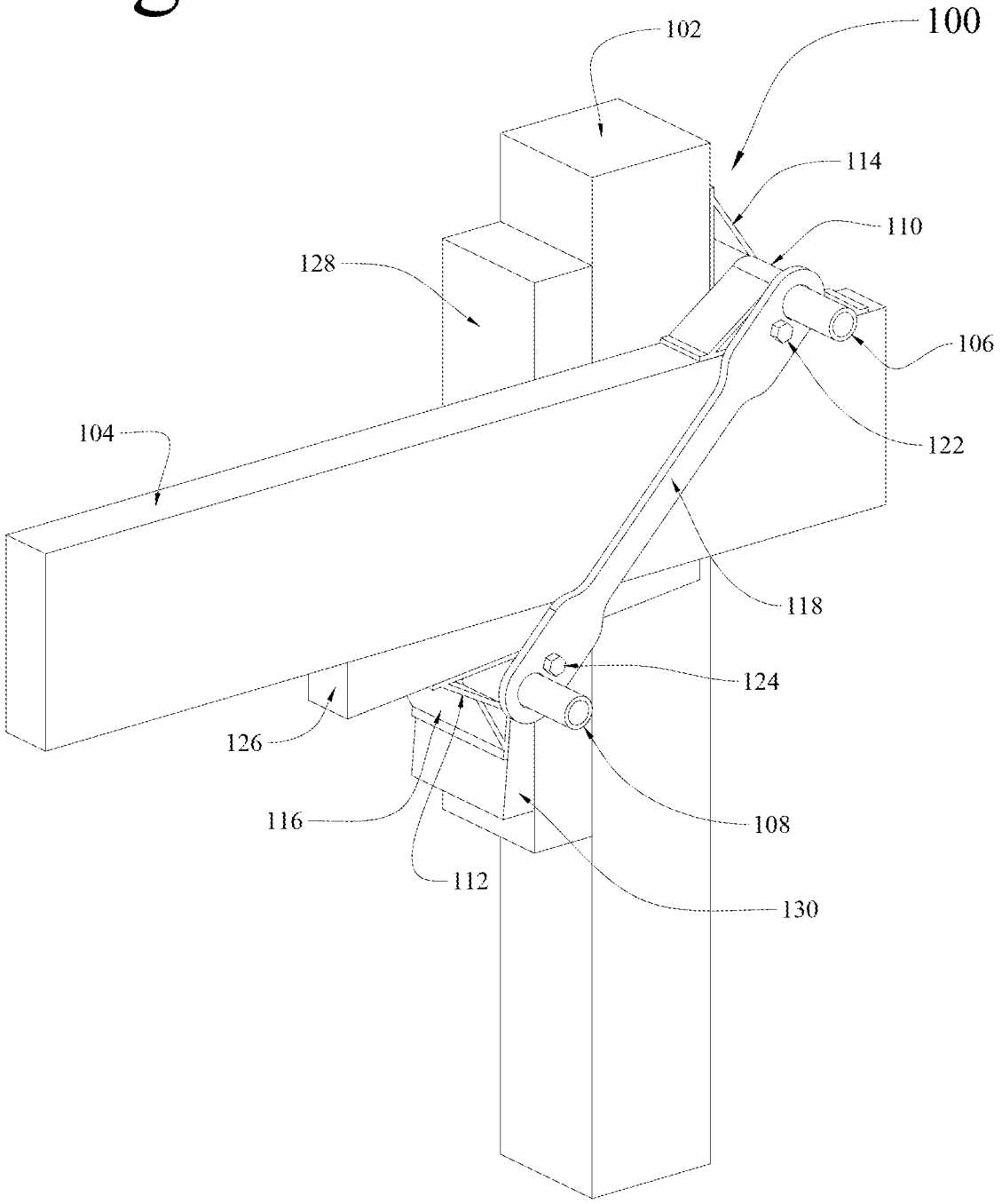
FIG. 1 illustrates a first example embodiment of a rolling block (RBR) connector, in accordance with some embodiments.

Referring now to FIG. 1, a side view of an assembled RBR connector 100 in conjunction with column structural member 102 and beam structural member 104 is shown. Collectively, the column structural member 102 and beam structural member 104 may be referred to as "the members 102 and 104." Specifically, the RBR connector 100 includes the column blocks 114, 116, the beam blocks 110, 112, the upper shaft 106, and the lower shaft 108. The shafts 106 and 108 may be solid or hollow such as pipe or tubing and with the shear and bending strength needed for the connection forces. Although the shafts 106 and 108 are shown as having a tubular shape, the disclosure is not intended to be so limited such that the shafts 106 and 108 make take any shape. Shafts 106 and 108 are free to slide laterally when no loads are applied to the RBR connector, such as during the erection process.

When under load, shafts 106 and 108 are restrained from lateral movement by the clamping force of the block bearing against the shafts. Though not necessarily needed, a shaft locking collar (not shown) may be installed adjacent to RBR connectors to provide supplemental retention clamping. The two shafts are held at a fixed spacing by linkage 118 on the beam side of the connection and linkage 120 on the column side (view is obstructed). The upper screw fastener 122, and the lower screw fastener 124 run transversely through openings in the block bodies and linkages and are tightened against the linkage clamping the members 102 and 104 and blocks together. Beam insert or wedge spacer 126, column insert or wedge spacers 128 and 130 fit in between members 102 and 104 and blocks. It should be noted that the inserts and spacers serve the same purpose, e.g., provide an insert between either a column or beam and the corresponding member (e.g., members 102, 104). The descriptive words top, bottom, upper and lower are used with respect to the orientation shown on these figures.

The linkages 118 and 120 may be fixed-length linkages (such as those shown in at least FIGS. 1-3A and 5A-5E) or variable-length linkages (not shown). For example, a variable-length linkage may comprise two components, each having threads wherein a first component mates with a second, hollow component via threads. The threaded mating enables the first component to threadably enter the second, hollow component thereby decreasing the length of the linkage and threadably exit thereby increasing the length of the linkage.

Figure 2:
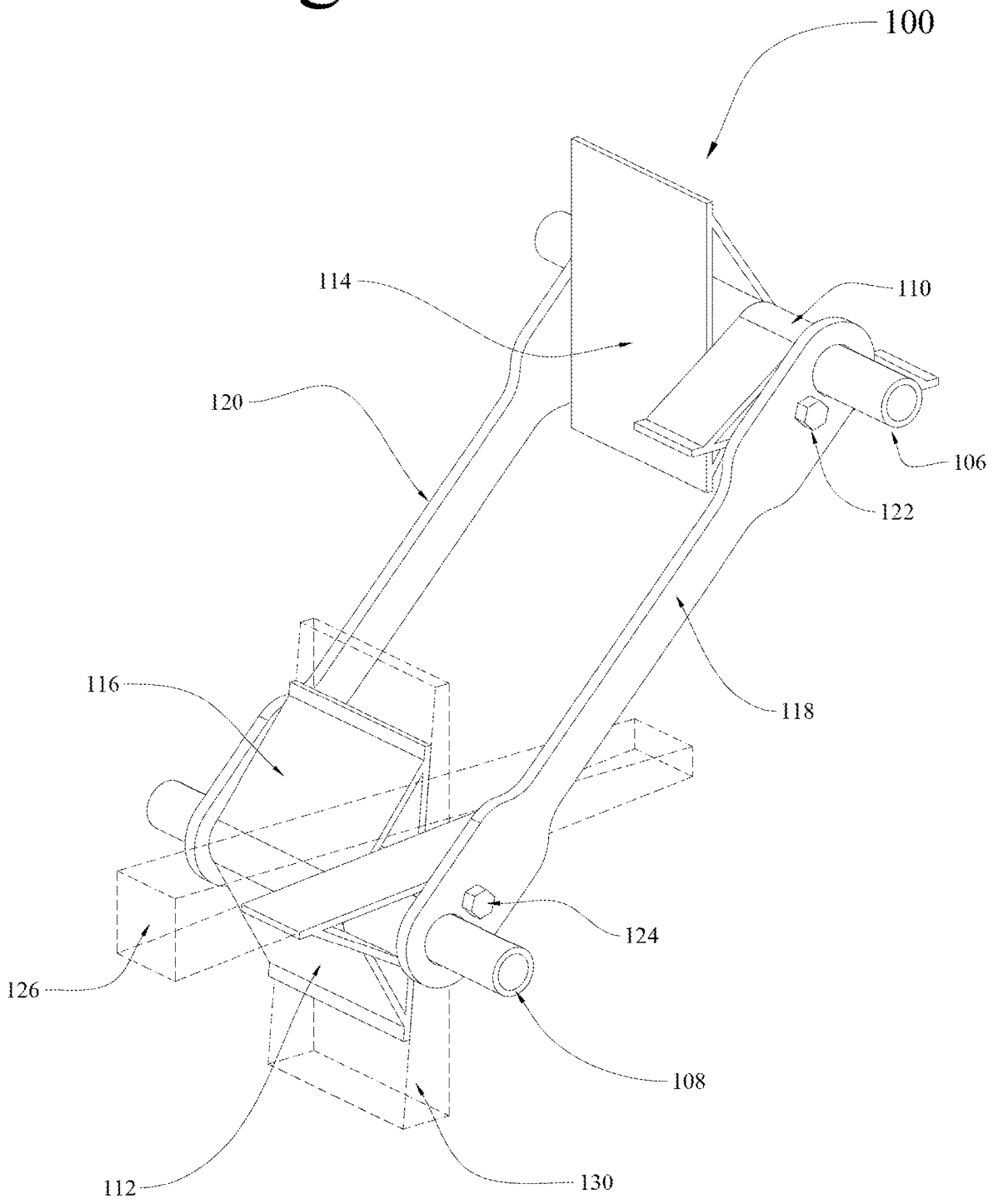
FIG. 2 show the assembled parts of the same connector of FIG. 1 with the structural members removed.

Referring to FIG. 2, one embodiment of a RBR connector is shown. In contrast to FIG. 1, FIG. 2 illustrates the RBR connector 100 without the insert or wedge spacers 126, 128 and 130. Wedges and spacers may have a higher crushing strength then the members 102 and 104 being connected and are fixed in position by nails, screws, or other fastener methods dependent on the particular installation for which the RBR connectors are used.

As referred to herein, the RBR connector 100 may include a first restraint assembly, a second restraint assembly, a first linkage 118 and a second linkage 120. The first restraint assembly may include (i) a first block (e.g., the beam block 110), (ii) a second block (e.g., the column block 114), and (iii) a first shaft (e.g., the shaft 106) that passes through channels of the first block and the second block. The second restraint assembly may include (i) a third block (e.g., the beam block 112), (ii) a fourth block (e.g., the column block 116), and (iii) a second shaft (e.g., the shaft 108) that passes through channels of the third block and the fourth block. As shown, the first linkage couples the first restraint assembly with the second restraint assembly, wherein the first shaft and the second shaft each pass through the first linkage. Additionally, a second linkage couples the first restraint assembly with the second restraint assembly, wherein the first shaft and the second shaft each pass through the second linkage. In some embodiments, the second restraint assembly is configured to be located diagonally across the joint intersection from the first restraint assembly.

Referring to FIGS. 3A-3D, an expanded disassembly of the RBR connector 100 is illustrated. The center longitudinal axis for the shafts 106 and 108 are shown by dotted lines. As an example, for transverse clamping, bolts are used for transverse clamping fasteners 122 and 124 and pass through holes in linkage 118 and then are screwed into linkage 120 that has threaded holes. Clamping fastener system and methods vary according to the particular installation. In some embodiments, the first restraint assembly includes a first transverse clamp module (e.g., clamping fastener 122) configured to apply pressure to an external side of each of the first linkage and the second linkage. And in some embodiments, the second restraint assembly includes a second transverse clamp module (e.g., clamping fastener 124) configured to apply pressure to an external side of each of the first linkage and the second linkage.

Figure 3A:
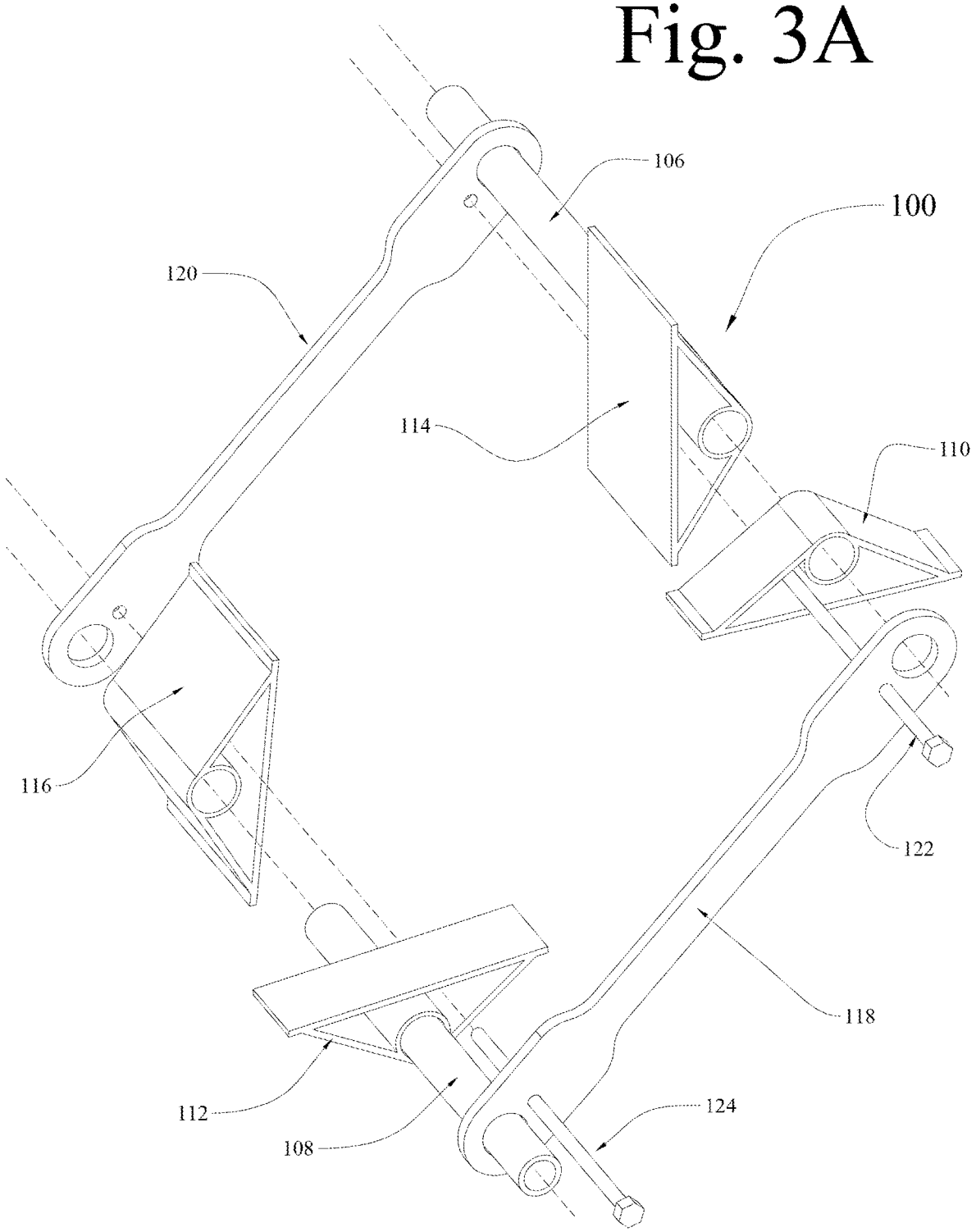
FIG. 3A-3D show a disassembly blow up of the parts shown in FIG. 2.
Figure 3B:
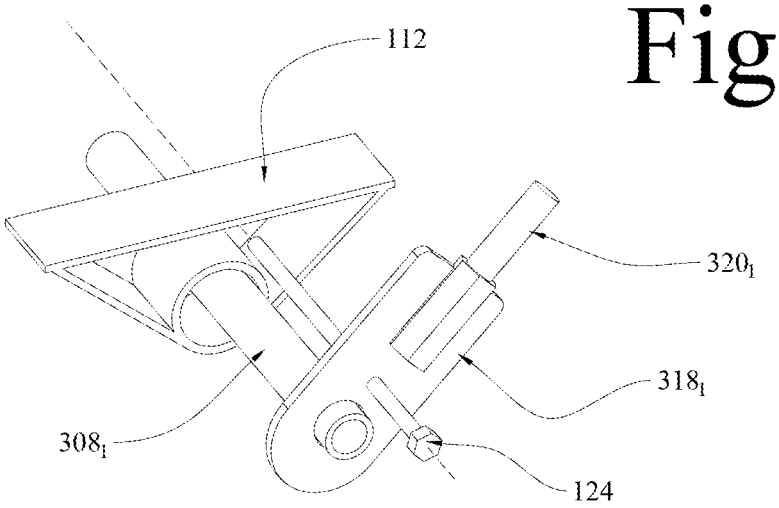
Figure 3C:
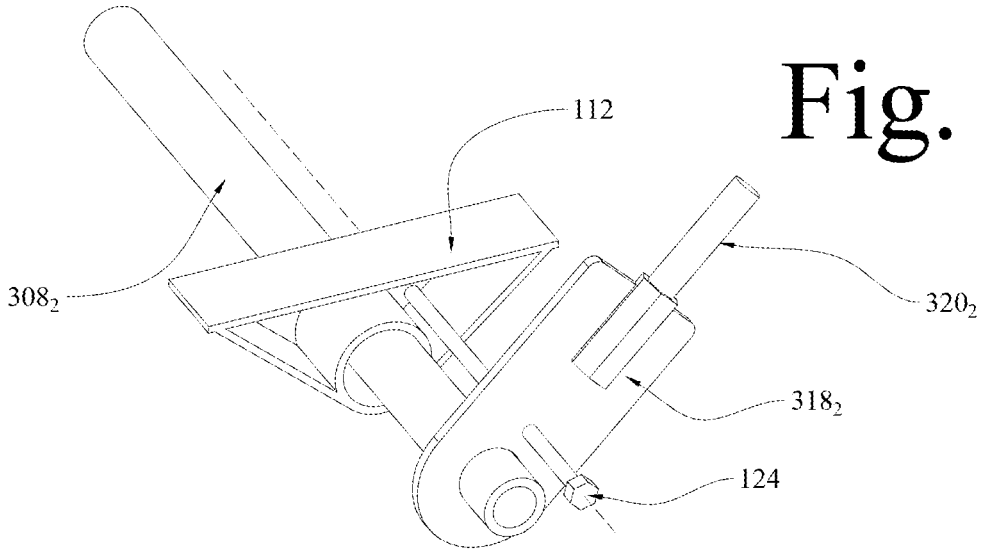
Figure 3D:
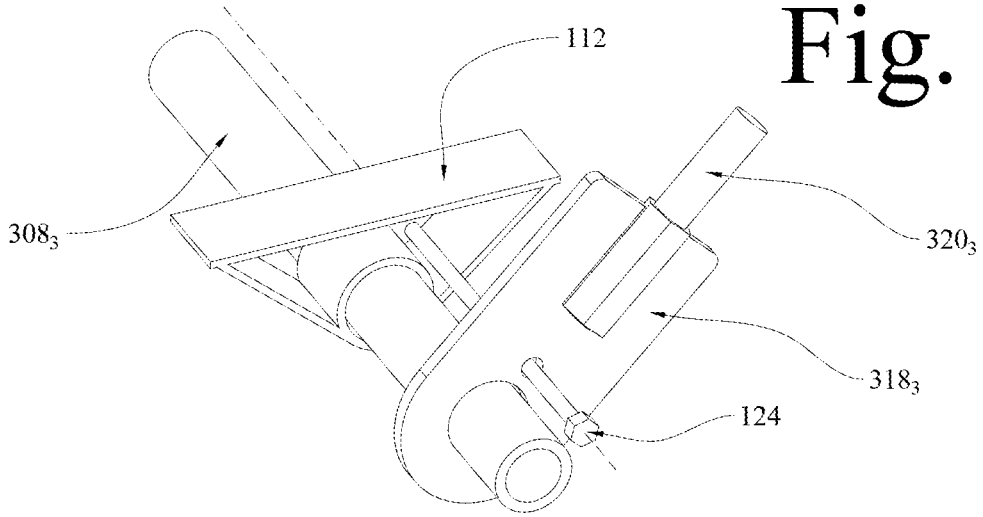

When RBR connector 100 is subjected to loading, the shaft 108 makes contact with the sleeve of block 112 in one location only so that the sleeve may be made oversize to fit a range of shafts for the block to have a wider range of capacities and thereby increase its usefulness. Referring specifically to FIGS. 3B-3D, the shafts $\mathbf{308}_1$, $\mathbf{308}_2$ and $\mathbf{308}_3$ take the place of the shaft 108 and are shown in increasing larger shaft sizes (e.g., $\mathbf{308}_1$, $\mathbf{308}_2$, and 3083). The linkage eye plate 318 is similar to eye plate 118 with addition of a threaded coupling for threaded link 320.

Figure 4:
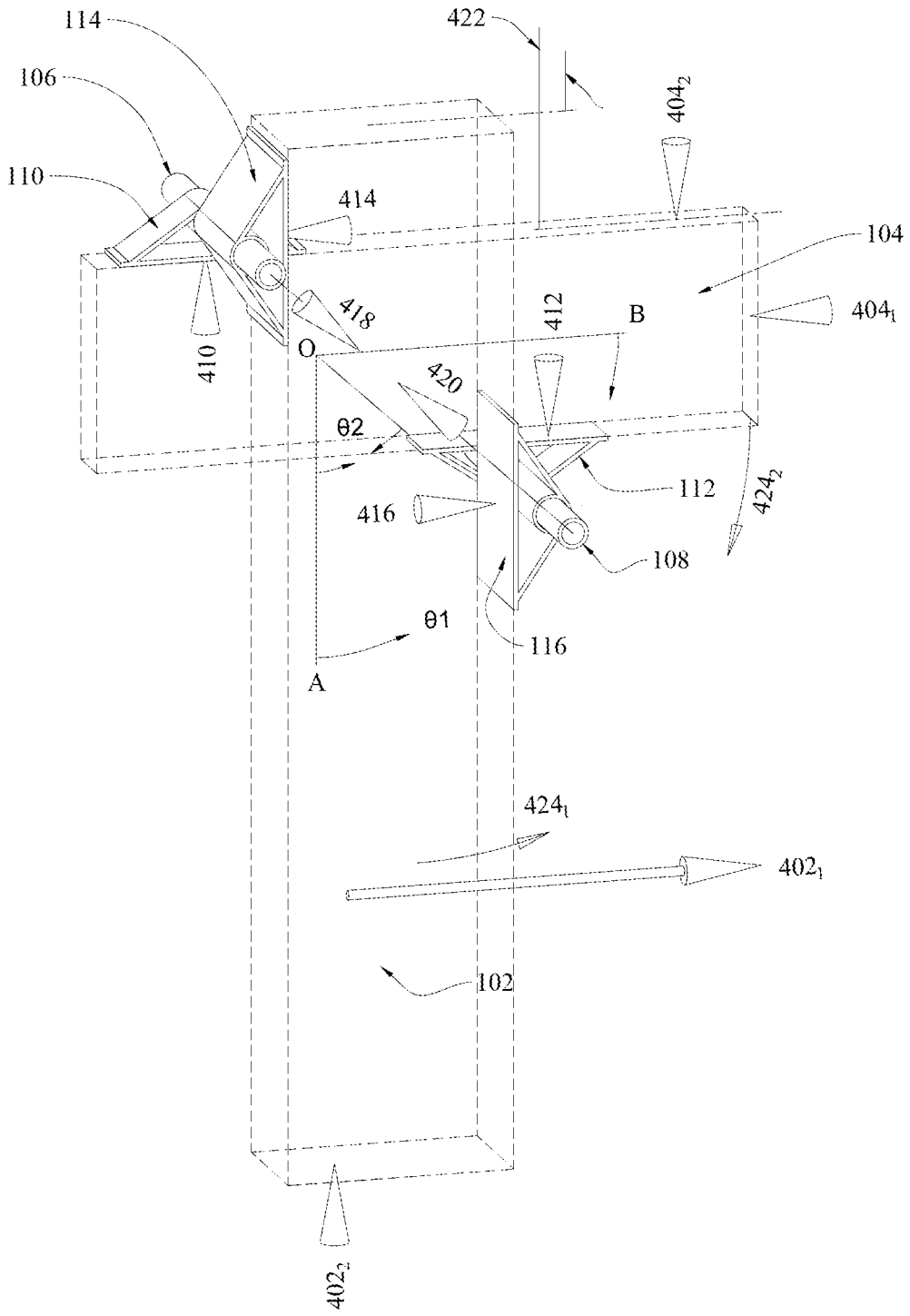
FIG. 4 shows force diagram for the loads on the members and how they are resolved by the connector.

Referring to FIG. 4, embodiments illustrate external loads on the members 102 and 104 and the resisting internal forces developed within the connector to maintain the geometry of a joint are shown. It should be understood that the RBR connector includes the transverse side clamp screw fasteners 122 and 124, and linkages 118 and 120; however, such are not shown in FIG. 4 for purposes of clarity in order to illustrate various forces acting on the RBR connector 100. AO is a line parallel with the column axis and OB is a line parallel with the beam axis that intersect at the point O located on the linkage center. The angle formed by AO and OB is referred to as AOB or angle theta ($\theta_1$).

Beam forces 404$_1$-404$_2$ and column forces 402$_1$-402$_2$ form a moment about the point O that tend to make the angle $\theta_1$ smaller with directions of closure shown by arrows 424$_1$ and 424$_2$. These forces cause the beam and column to move towards the rolling blocks mounted on shafts that are held in place by linkages. Column movement is resisted by block forces 414 and 416. Beam movement is resisted by block forces 410 and 412. The lower block restraining forces 412 and 416 press against the lower shaft 108. The upper block restraining forces 410 and 414 press against the upper shaft 106.

The ends of the upper shaft 106 are restrained by the linkage force indicated by 418. The ends of the lower shaft are restrained by the linkage force indicated by 420. The forces 418 and 420 are in equal but opposite in direction within the links themselves, and; thus, restrain movement of the members 102 and 104. As a result, movement of the members 102 and 104 is restrained to form a moment connection.

The offset distance between centerline axis of the beam and column in the transverse direction is indicated by the dimension 422. The beam loads 410,412 and column loads 414,416 pass through their respective centerline axis but because of this offset, a twisting moment about the vertical column axis occurs. The transverse clamp screw fasteners 122 and 124 resists lateral forces that develop in the connector to prevent distortion when subjected to this twisting moment.

Transverse side clamp screw fasteners 122 and 124 pull linkage eye bar 118 and 120 together to clamp upper blocks, lower blocks and members between them. Referring back to FIG. 3A, the centrally located, unobstructed path of transverse side clamp screw fasteners 122, 124 is shown between the block sleeve 1200 and block pad 1204 structure of FIG. 12. The geometry of the linkage, blocks and transverse side clamp screw fastener is designed to provide clearance between the shaft and members. Threaded fasteners may be used for transverse side clamp screw fastener 122 and 124.

Selection of the linkage alternative to use for a project is made considering factors such as RBR connector size, strength design requirement, quantity, fabrication and materials. Alternative linkages with provision for transverse clamping are shown in FIGS. 5A-5E having holes for shafts 106, 108 and transverse side clamp screw fastener 122 and 124. As a means to simplify installation and reduce the number of required parts, linkage holes that receive transverse screw fasteners may be drilled and tapped in lieu of using nuts. In some embodiments, the link may be formed from bar stock or strands of material having the required strength.

Figure 5A:
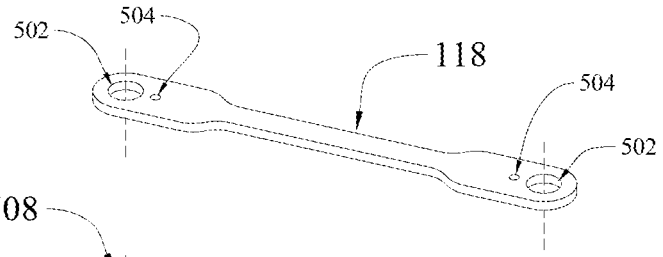
FIGS. 5A-5E show different type of linkages that may be used for the connector.
Figure 5B:
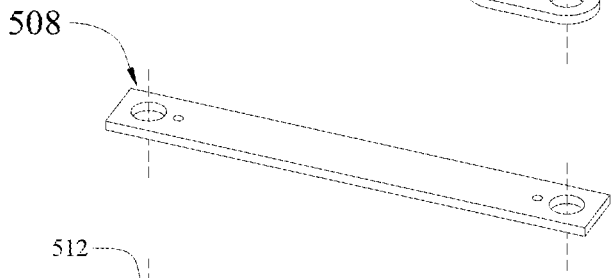

Referring to FIG. 5A, the linkage 118, e.g. an eye-bar, is shown having hole 502 configured to receive shafts 106, 108, and hole 504 configured to receive transverse screw fasteners 122, 124. In some embodiments, as shown herein, the center portion of the linkage may be reduced in width relative to the exterior ends of the linkage 118 when weight reduction is needed. Referring to FIG. 5B, a simplified one-piece linkage, e.g., a flat bar, 508 is shown. The linkage 508 may have a consistent width throughout its length.

Figure 5C:
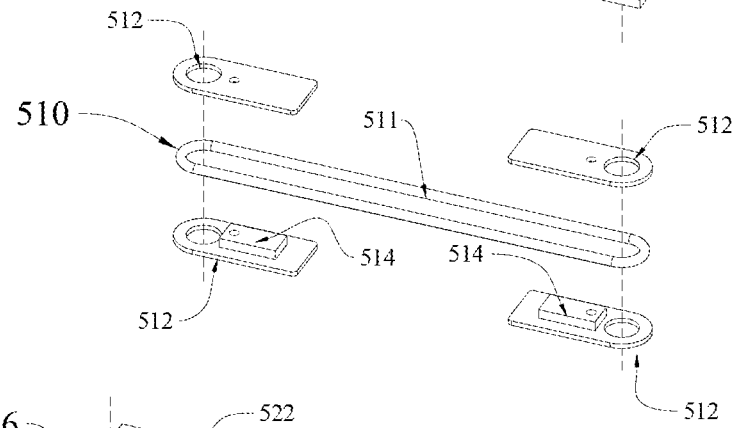

An alternative linkage is shown in FIG. 5C. The linkage 510 includes a solid continuous formed link 511 is located between a pair of plates 512 located at each end. The radius of the link is made to fit shafts 106, 108. The piece 514 may have the same thickness and interior width of link 511 and may be attached to one of the plates 512. The piece 514 may be threaded for fasteners 122 and 124. With the transverse screw fasteners installed, the combined plate and insert assembly is held aligned with the link and transmits lateral forces for transverse clamping.

Figure 5D:
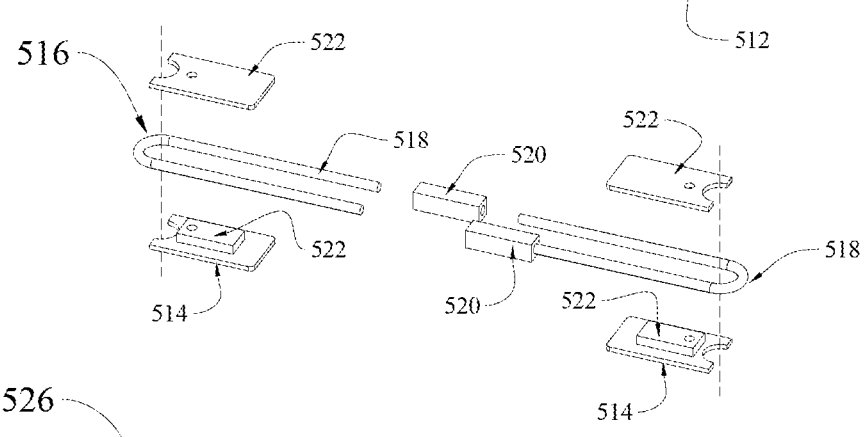

As yet another alternative embodiment, a linkage 516 is illustrated in FIG. 5D. The linkage 516 may comprise right and left threaded half links 518 that are joined with matching threaded coupling nuts 520 as shown. The combined linkage 516 may be located between a pair of plates 522. The linkage 516 may also include the piece 514 as discussed in FIG. 5C. The linkage 516 may be used to make an additional RBR connection for existing installed shafting together with half block 608 as shown in FIG. 14 without having to disassemble existing structure for installation.

Figure 5E:
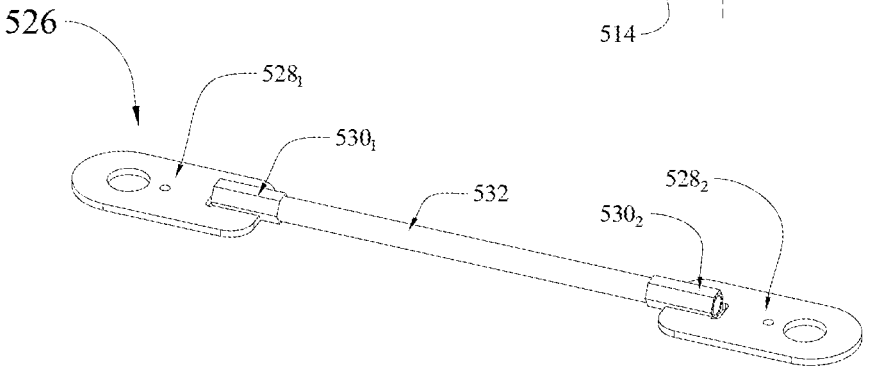

Further, the linkage 530 shown in FIG. 5E provides yet another alternative embodiment. The link 526 may be fabricated with ends 528$_{1\text{-}2}$, coupling nuts or internal threaded equivalent 530$_{1\text{-}2}$ and bar 532 having threaded ends. Threaded bar 532 is cut and threaded for the length needed.

Figure 6:
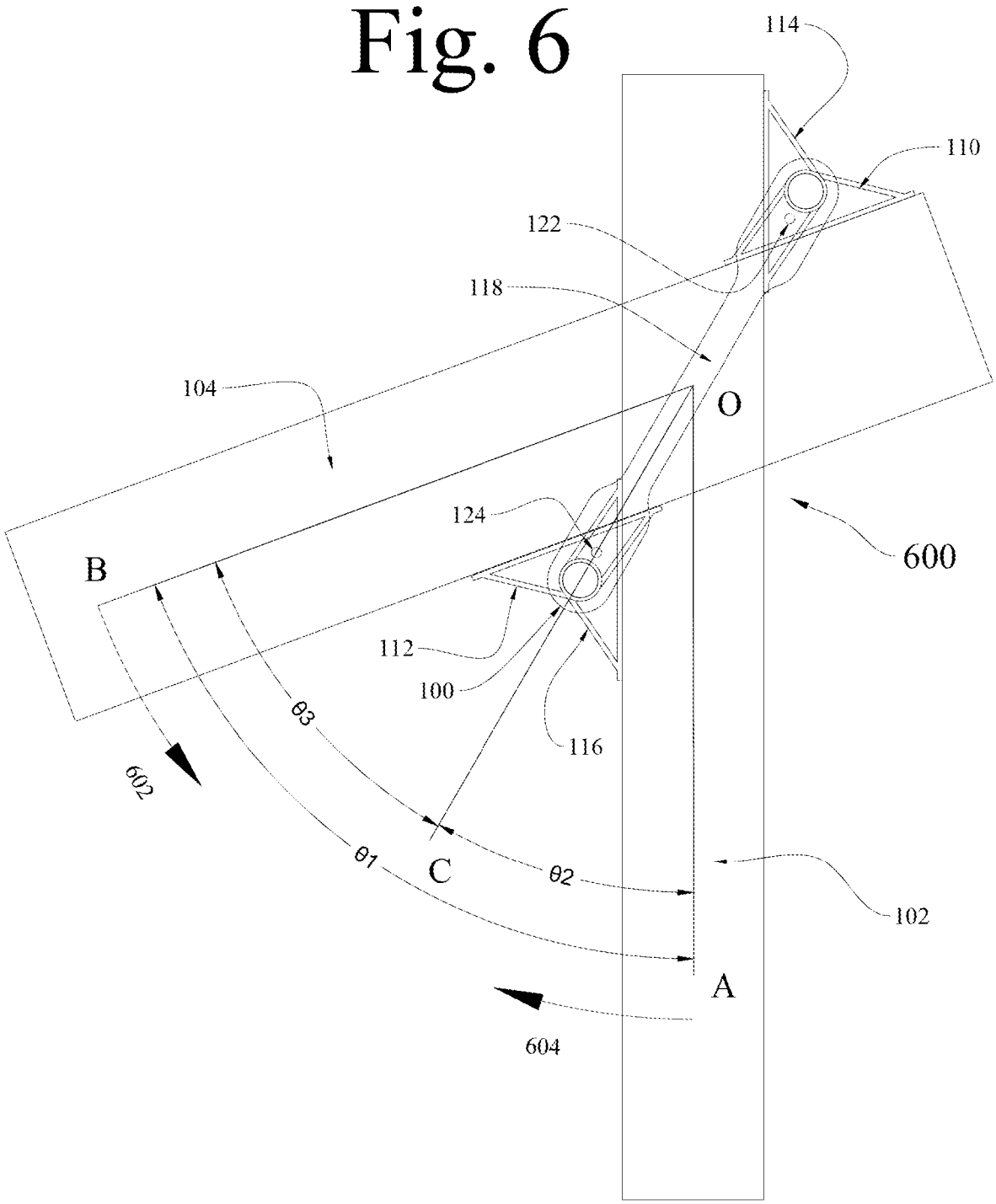
FIG. 6 shows joint angle using fixed length links, restraint blocks, and members without shim spacers installed.

Five different joints are illustrated in FIGS. 6-10, utilizing components of FIGS. 1-3 show member intersection angles noted by angle $\theta_1$. Angles $\theta_2$ and $\theta_3$ indicates linkage angles. Referring to FIG. 6, the joint 600 includes column member 102 and beam member 104 without the use of block inserts or wedge spacers, thus resulting in the angle $\theta_1$ being acute (i.e., between 0 and 90 degrees).

In some embodiments, column or beam block insert spacers, or wedge spacers are installed to adjust the connection to the angle $\theta_1$, the linkage angle $\theta_2$ and the linkage angle $\theta_3$. The required block inserts and wedge spacer thickness is determined graphically, mathematically, or in the field and based on the desired angles ($\theta_1$, $\theta_2$, and $\theta_3$). A block insert spacer with parallel sides of a specific thickness used by itself will make a set angle. The insert spacer installation can be designed to supplement the column or beam strength determined by its structural value as a function of width, thickness, length and method of attachment. Tapered wedge spacers of variable thickness allow a range of angle adjustment for angle $\theta_1$. One benefit of the RBR connectors disclosed herein, is that each will self-adjust to the angle of an insert spacer or wedge spacer.

Linkage lengths determine the minimum angle $\theta_1$ without spacers as shown in FIG. 6. A longer linkage will make a smaller angle $\theta_1$ and a shorter linkage will make angle $\theta_1$ larger. Members 102 and 104 resist movement for loads in the direction indicated by arrows 602 and 604 for the single RBR connector 100 shown.

Figure 7:
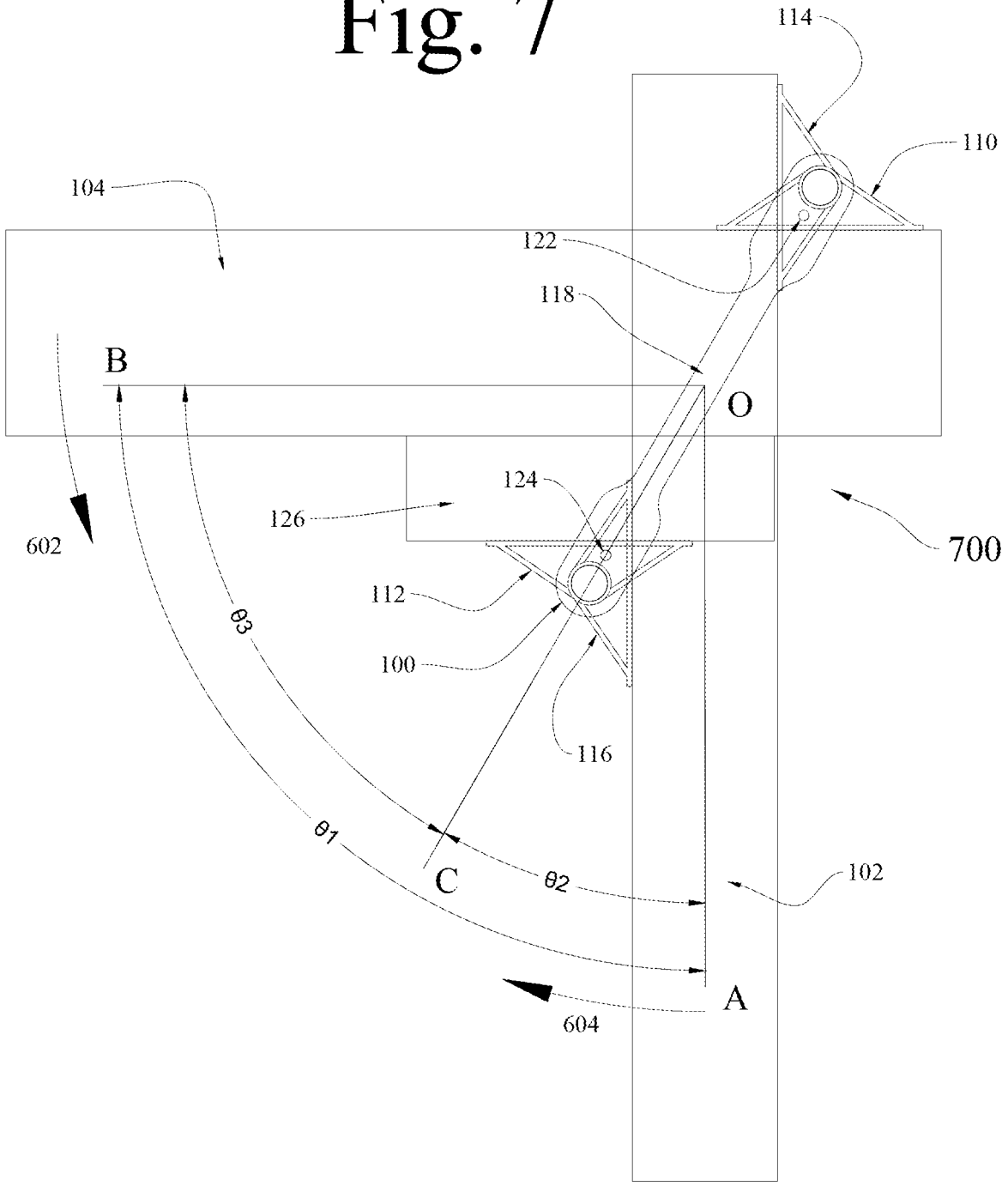
FIG. 7 shows the same parts to form a 90-degree angle joint using a spacer installed between the beam block and beam.
Figure 8:
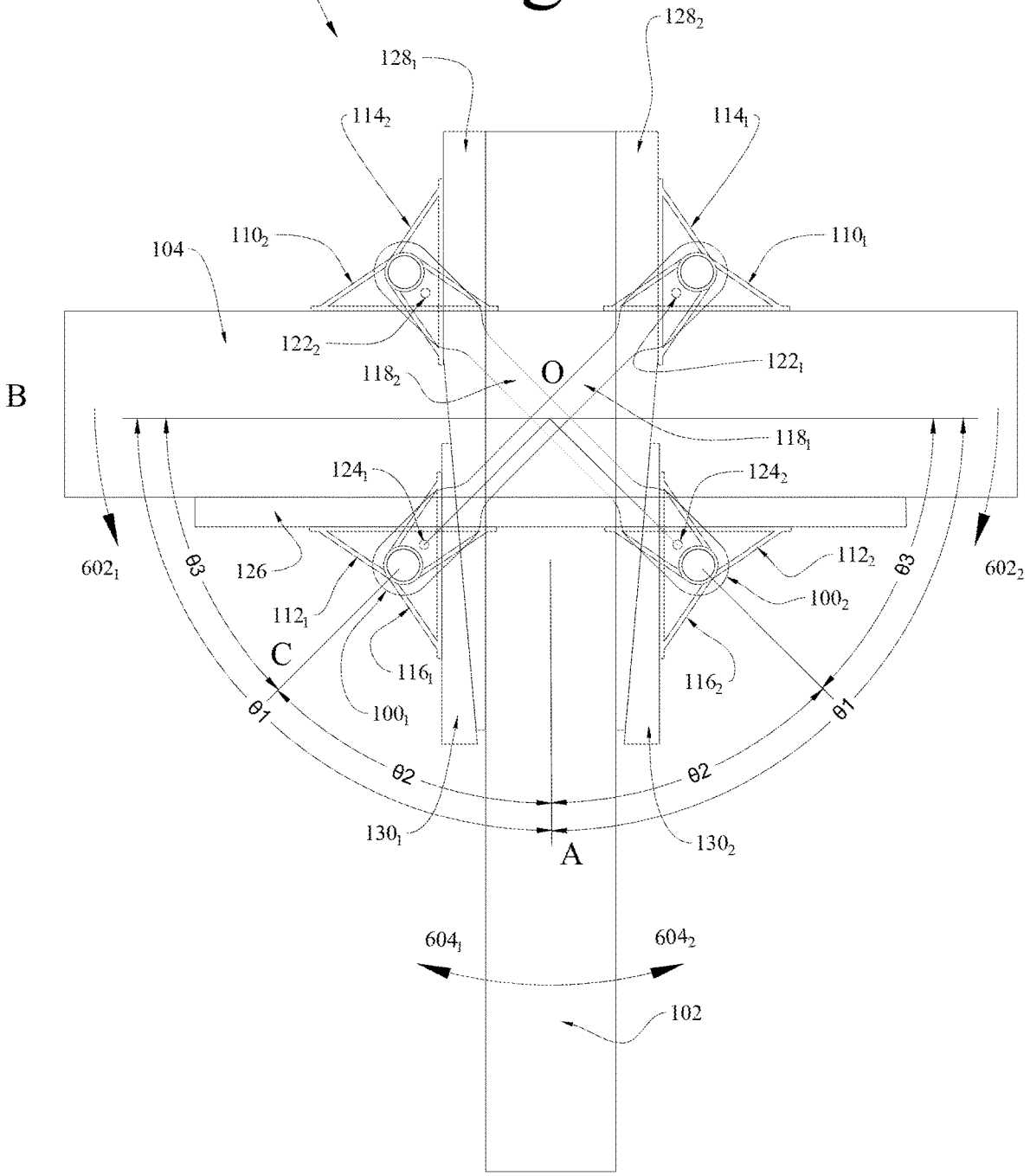
FIG. 8 shows the same parts installed on both diagonals to form a double RBR connection having a 90-degree angle joint with 45 degree linkages using spacers installed between the beam block and beam and also between the column block and column.

With respect to FIGS. 7-10, a plurality of j oints are provided that illustrate how the addition of an insert is used to adjust the angle $\theta_1$ given a set linkage length. Referring to FIG. 7, insert spacer 126 is inserted between the beam block 112 and the beam member 104 to adjust the angle $\theta_1$ (e.g., to be 90 degrees) of the joint 700. Referring to FIG. 8, the thickness of insert spacers 126, 128 and 130 are made for $\theta_1$ to be 90 degrees and $\theta_2$ and $\theta_3$ each to be 45 degrees for joint 800. Double RBR connectors as shown in FIG. 8 are installed to provide fixed end moment (FEM) restraint in both directions of rotation.

Figure 9:
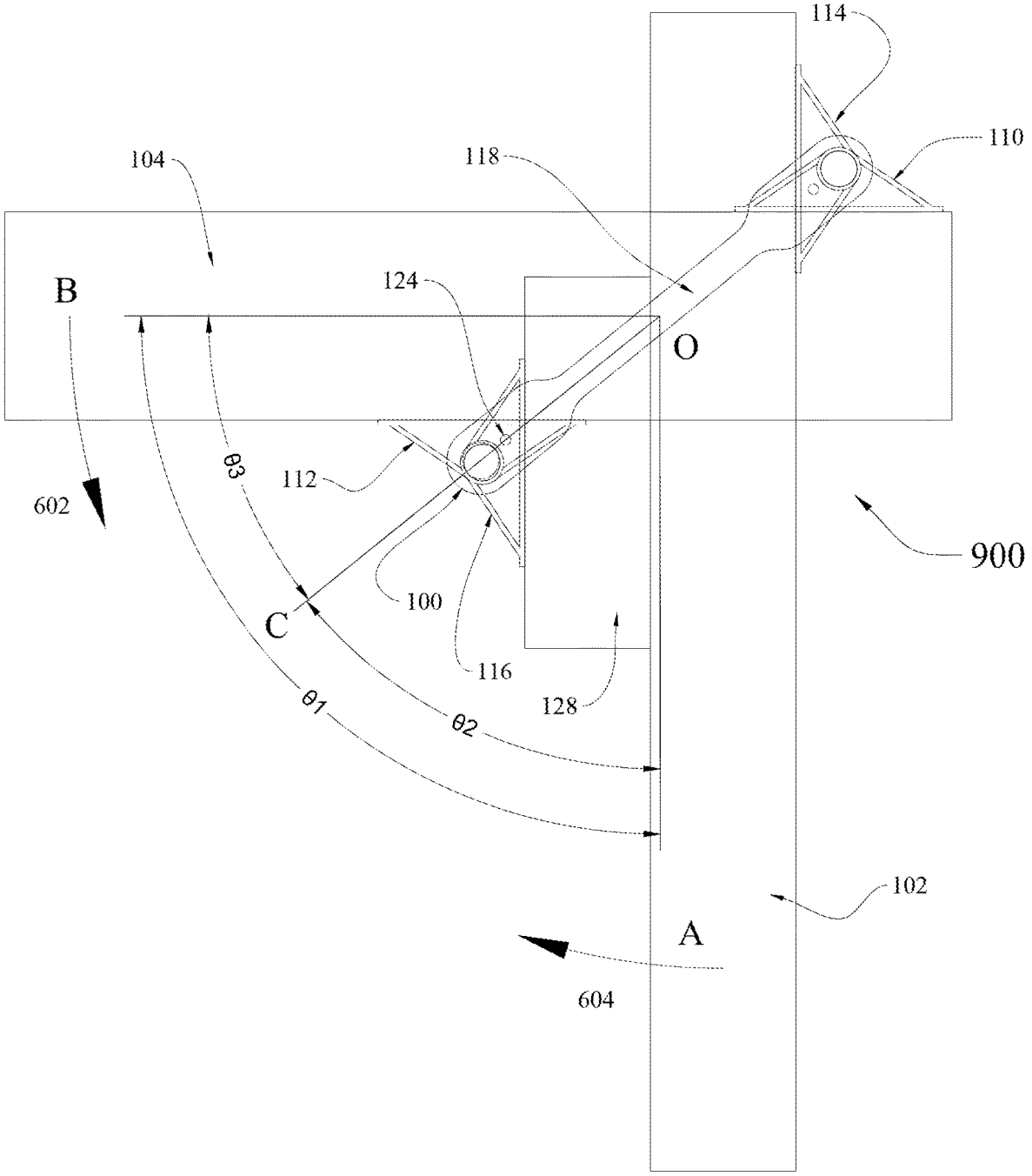
FIG. 9 shows the same parts to form a 90-degree angle joint using a spacer installed between the column block and the column.
Figure 10:
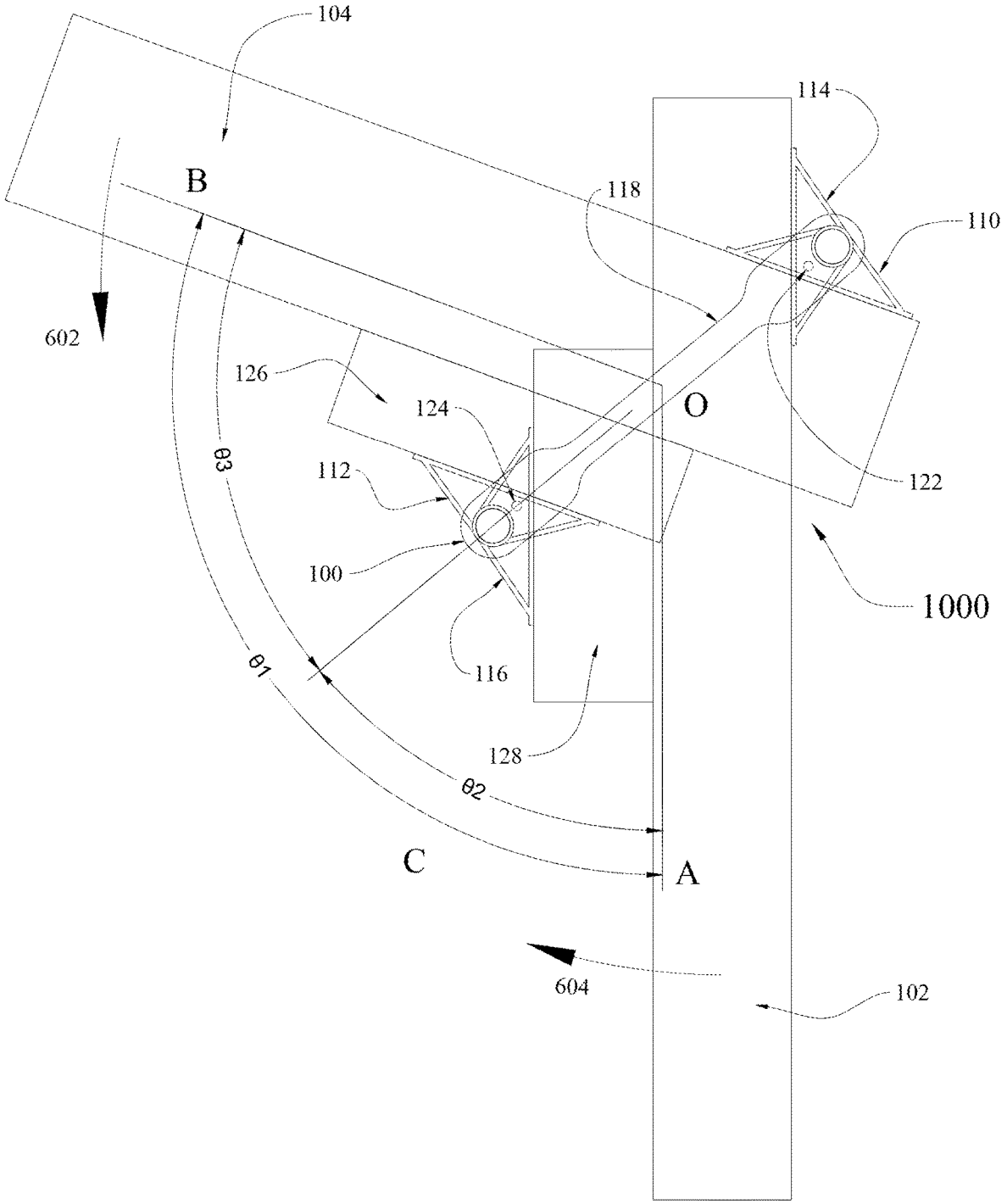
FIG. 10 shows the same parts to form a 110-degree angle joint using spacers installed between the beam block and beam and also between the column block and column.

Referring to FIG. 9, insert spacer 128 is inserted between the column block 116 and the column member 102 to adjust the angle $\theta_1$ (e.g., to be 90 degrees) of the joint 900. Referring to FIG. 10, insert spacer 126 is inserted between the beam block 112 and the beam member 104 and insert spacer 128 is inserted between the column block 116 and the column member 102 to adjust the angle $\theta_1$ (e.g., to be obtuse, e.g., greater than 90 degrees) of the joint 1000.

Figure 11:
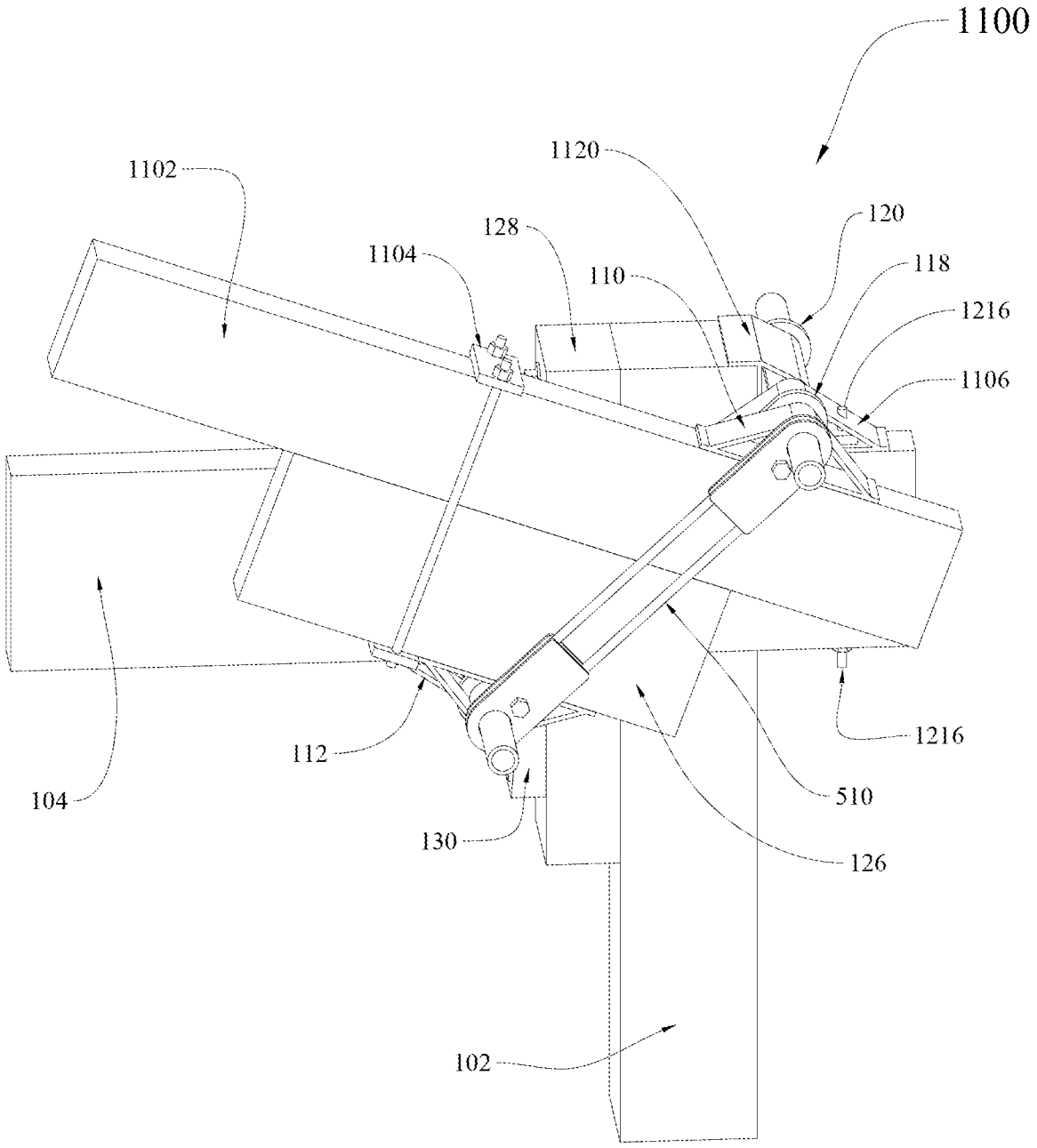
FIG. 11 shows a joint connection having a vertical column, a first beam positioned at 90 degrees relative to the vertical column and a rafter beam positioned at 20 degrees relative to the first beam.

A RBR connector with a fixed distance between shafts may be used to join a number of members side by side at various different angles. The right-angle condition in FIG. 9 combined with the obtuse angle shown in FIG. 10 to form a three-member connection is useful to form a sloped rafter and beam connected to a column as RBR connector 1100 is shown in FIG. 11. Clamp 1104 clamps the beam 1102 together with insert spacer 126. An extra linkage 510 may be added onto the shafts on the outside of beam 1102 to supplement the strength provided by linkages 118 and 120. Column cap block 1120 is fabricated with leg 1202 bent and extended over the top of column 102 as a unique method for transferring vertical loads to column 102. Beam top block 1106 connects to beam 104 using fastener 1216. Additional linkages such as 118 may be added to the shafts between members as needed for strength.

Figure 12A:
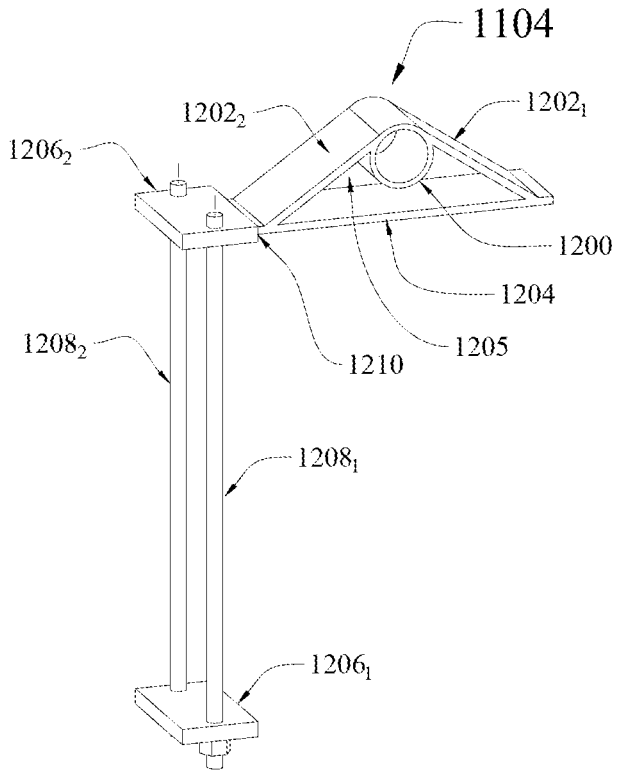
FIGS. 12A-12B illustrate different type of blocks that may be used for the connector.

Various block modifications are utilized to connect specific blocks to members for the purpose of transferring structural member loads and fixing the RBR connectors in place. FIG. 12A shows block 110 having two inclined plates $\mathbf{1202}_1$ and $\mathbf{1202}_2$ referred to as legs, sleeve 1200 which shaft passes through, bottom plate 1204 referred to as a "pad." The block is open between the sleeve legs and pad 1205 through which the transverse clamping screw 122, 124 pass. The pad area is made sufficient for the bearing pressure not to crush the member. Optional plates 1206 and fasteners $\mathbf{1208}_1$-$\mathbf{1208}_2$ provide a clamp to restrain block 110 at the contact point 1210 between pad 1204 and plate $\mathbf{1206}_2$ by direct contact or attaching $\mathbf{1206}_2$ and 1204 together.

Figure 12B:
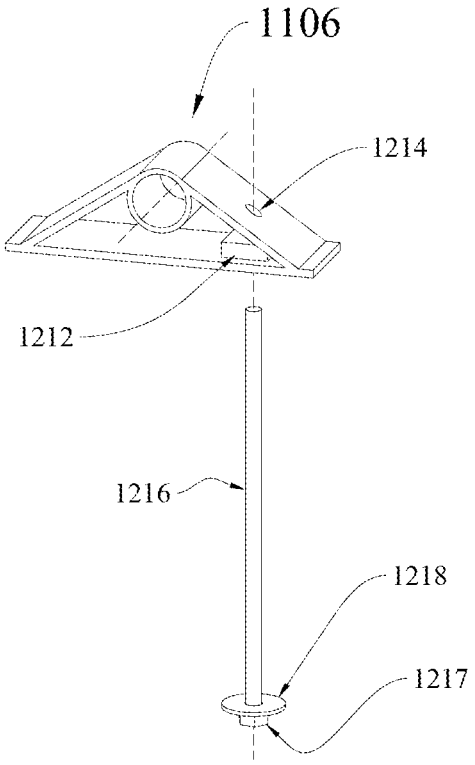

Block 1106 in FIG. 12B is block 110 modified to have a threaded fastener insert 1212, and a leg having thru-hole 1214. It is used together with a bolt or threaded rod fastener 1216 and washer 1218 to both clamp this block and transfer forces to a member. The threaded insert may be substituted by drill and tapping the pad or using a nut for attaching fastener 1216.

A space frame as shown in FIG. 13 is made with RBR connectors to form FEM connections between panel 1302 acting as a beam and four columns $\mathbf{102}_{1\text{-}4}$. These connectors make it possible to use the strength of the floor panels to resist both vertical and lateral forces. The panel is restrained between blocks $\mathbf{1312}_{1\text{-}20}$ mounted on shafts $\mathbf{106}_{1\text{-}2}$ and $\mathbf{108}_{1\text{-}2}$. Insert spacer 126 is made the same width as the panel and sized to carry the vertical panel loads. Rods with end threads $\mathbf{1304}_{1\text{-}2}$ extend between columns and are tensioned by nut 1306 with washer 1308 bearing against columns having holes. Tensioning these rods forces the columns towards each other and produces opposite direction moments on the opposing column to make the panel bow upwards and form what is called a crown. The structure in this condition is rigid, without slack in any members, and springs back when loads are applied and released. This relatively light structure quickly transfers forces throughout its members to collectively resist lateral loads. The structure is set on castors $\mathbf{1310}_{1\text{-}4}$ to illustrate that it is a free-standing structure not needing any lateral support or foundation connection for stability.

FIG. 14 shows block 1312 with the top half of the shaft sleeve 1404 removed to allow it to be installed on existing shafts together with a linkage, e.g., the linkage 516. It is made with a force fit for it to be retained on a shaft with connectors in the unloaded condition. In the loaded condition, the block held in position by the force of the shaft pressing it against the member. Holes $\mathbf{1402}_1$-$\mathbf{1402}_2$ are for attaching this block to spacers or members.

Figure 15A:
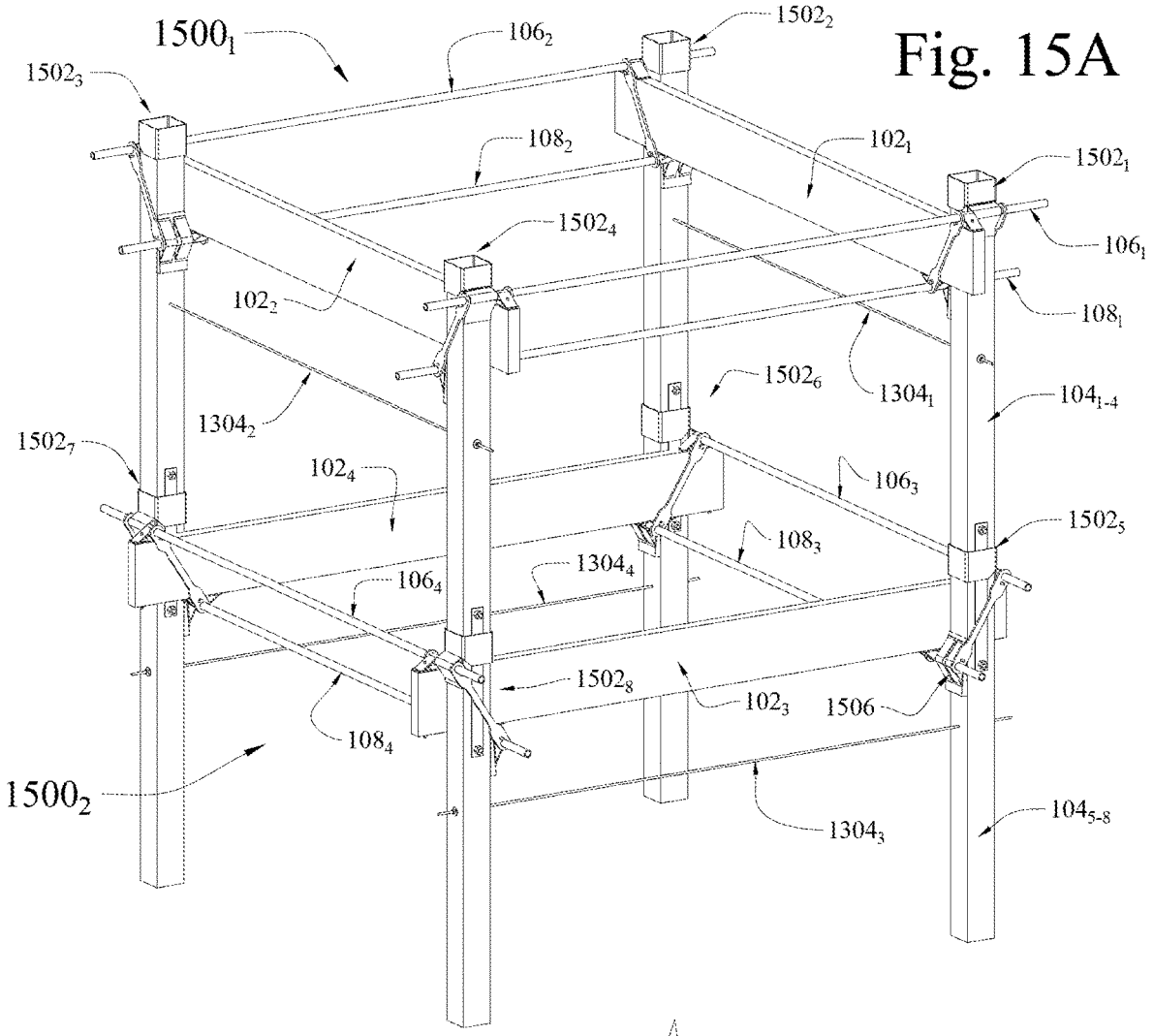
FIG. 15A shows two space structures composed of four columns, connectors and beams stacked on top of each other.
Figure 15B:
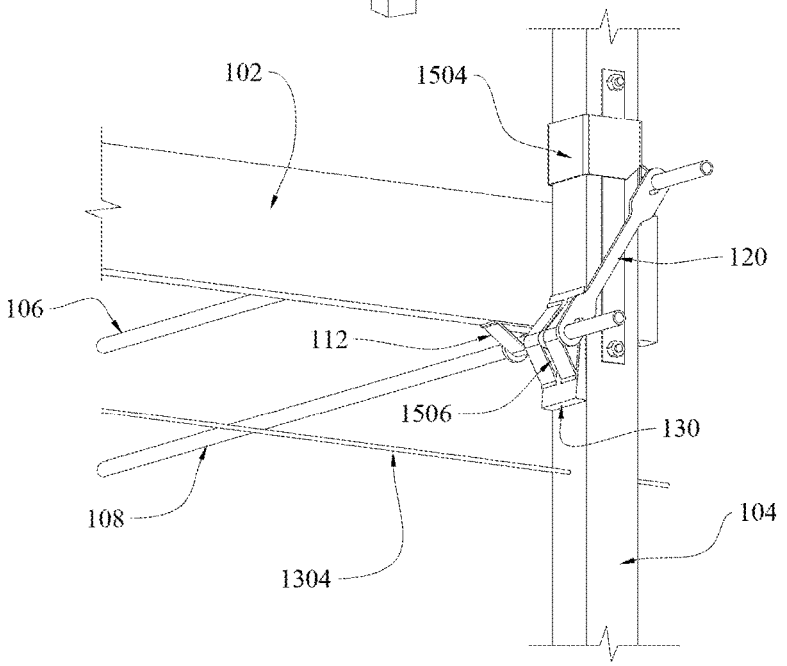
FIG. 15B shows one corner connection of the FIG. 15A space structure.

Structural frame modules $\mathbf{1500}_1$ and $\mathbf{1500}_2$ are stacked on top of each other as shown FIGS. 15A-15B to illustrate a second FEM space frame according to some embodiments. Connectors $\mathbf{1502}_{1\text{-}8}$ consist of parts of RBR connector 100 supplemented with column cap block 1120, beam top block 1106, bottom column block 1506, straps $\mathbf{1604}_1$-$\mathbf{1604}_2$ and column transition coupling 1504 as seen in FIGS. 12B, and 16A-16B. These connectors are first installed on their respective shafts 106 and 108 in the required sequence and orientation. The shafts with connector assemblies are supported off the ground. Members 102 and 104 are attached while transverse fasteners 122 and 124 are installed. In some embodiments, each shaft assembly is then lifted and the insert and wedge spacers installed and adjusted as needed to establish the wedge position used throughout the structure for connectors $\mathbf{1502}_{2\text{-}8}$.

The beams and columns are temporarily tied with lines or ropes to keep them from spreading apart. Erection is continued step by step in a planned sequence (although variation in order may occur in other embodiments): tie rods $\mathbf{1304}_1$ and $\mathbf{1304}_2$ with nuts and washers are installed; temporary lines are removed; the space frame geometry is checked and adjusted; spacers are fastened to members and blocks; transverse clamp fasteners 122 and 124 are tightened; the modules are stacked with $\mathbf{1500}_1$ on top of $\mathbf{1500}_2$; and fastened together using straps 1604.

FIG. 16A shows a column transition top block 1600 consisting of column cap block 1120, socket 1504 fit over and attached to 1120, tie straps 1604 inserted in gap between socket 1504 and column cap block 1120. This block is used at the top of a space frame for receiving the columns of a space frame stacked on top of it. The side straps 1604, fit through a gap between 1504 and 1120, are attached to the upper and lower space frame columns using fasteners $\mathbf{1606}_1$ and $\mathbf{1606}_2$. Tie straps 1604 provide for vertical holding, socket 1504 provides lateral position holding.

Multiple use of the same part, FIG. 16B shows double block 110 set side by side with spacer in between for the width of to be equal to the member. Separate blocks may be set side by side to form an equivalent width block. A spacer may be used between blocks provided the bearing pressure is less than that which would crush the member.

Figure 17A:
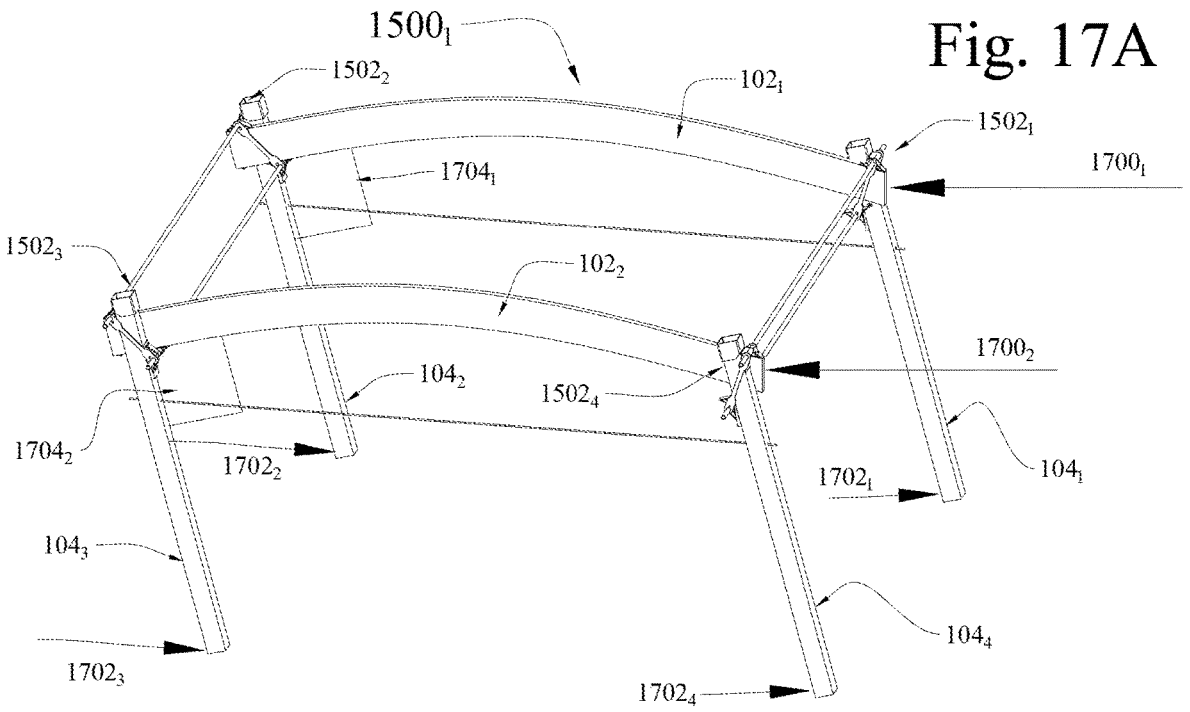
FIG. 17A shows a deflected shape of a single RBR connector four column space structure caused by loads parallel to beams.

Lateral loads from forces of nature may occur in any direction. As a means to illustrate how the structure reacts to such forces, deflection caused by lateral loads parallel to members is shown in FIG. 17A. Lateral loads $\mathbf{1700}_1$ and $\mathbf{1700}_2$ are applied to the structure at the position of connector $\mathbf{1502}_1$ and $\mathbf{1502}_4$ in the direction parallel to beams $\mathbf{102}_1$ and $\mathbf{102}_2$. These lateral loads will transfer to the ground via columns $\mathbf{104}_2$ and $\mathbf{104}_3$ because of the moment connections $\mathbf{1502}_2$ and $\mathbf{1502}_3$ joining them to beams $\mathbf{102}_1$ and $\mathbf{102}_2$. The base reactions of columns $\mathbf{104}_2$ and $\mathbf{104}_3$ are indicated by $\mathbf{1702}_2$ and $\mathbf{1702}_3$. Connections $\mathbf{1502}_1$ and $\mathbf{1502}_4$ do not pick up any of the lateral load because they do not work for loads in this direction and will act as if they are pinned connections so the base lateral reactions of columns $\mathbf{104}_1$ and $\mathbf{104}_4$ indicated by $\mathbf{1702}_1$ and $\mathbf{1702}_4$ will be negligible. The fixed end conditions at $\mathbf{1502}_2$ and $\mathbf{1502}_3$ are indicated by squares $\mathbf{1704}_1$ and $\mathbf{1704}_2$. The pinned connection reactions occurring at $\mathbf{1502}_1$ and $\mathbf{1502}_4$ are shown in FIG. 17A by the increase in angle at the connection. The beam deflection for $\mathbf{102}_{1\text{-}2}$ is shown and is equivalent to cantilever beam with a load on the end.

Figure 17B:
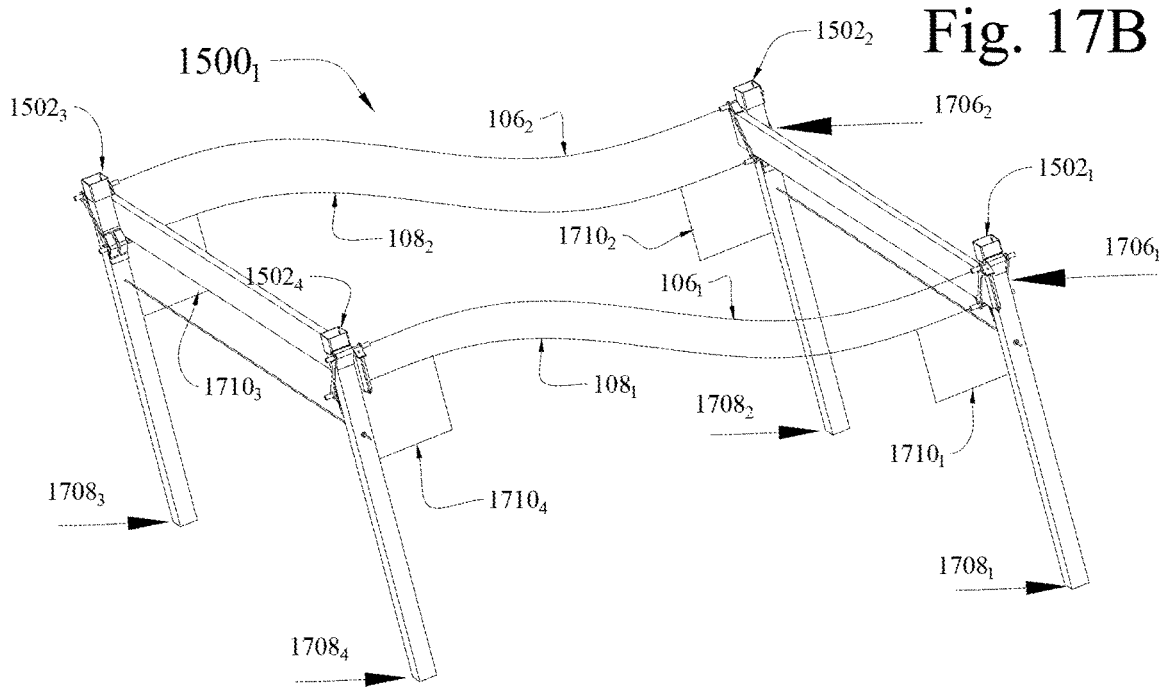
FIG. 17B shows a deflected shape of a single RBR connector four column space structure caused by loads parallel to shafts.

To illustrate lateral loads occurring perpendicular to the beams, FIG. 17B illustrate deflection of the structure with lateral loads parallel to shafts. Lateral loads $\mathbf{1706}_1$ and $\mathbf{1706}_2$ are applied at the position of connector $\mathbf{1502}_1$ and $\mathbf{1502}_2$ in the direction parallel to shafts $\mathbf{106}_1$, $\mathbf{106}_2$, $\mathbf{108}_1$, and $\mathbf{108}_2$. RBR connectors $\mathbf{1502}_{1\text{-}4}$ work as FEM connectors resisting the loads indicated by base reactions $\mathbf{1708}_{1\text{-}4}$ at the base of columns $\mathbf{104}_{1\text{-}4}$. The connection of the shafts at the RBR connectors work as FEM connections in both directions. This will produce a deflected shaft "S" shape and all base reactions will be equal.

Although the subject matter has been described in language specific to structural features or acts, it is to be understood that the subject matter defined in the appended claims is not necessarily limited to the specific features or acts described above. Rather, the specific features and acts described above are disclosed as examples of implementing the claims, and other equivalent features and acts are intended to be within the scope of the claims.

What is claimed is:

1. A rolling block restraint connector for forming a moment resisting connection at a joint intersection between a continuous first structural member and at least a continuous second structural member located adjacent to the continuous first structural member, the connector comprising:

a first restraint assembly including (i) a first block, (ii) a second block, and (iii) a first shaft that passes through channels of the first block and the second block;

a second restraint assembly including (i) a third block, (ii) a fourth block, and (iii) a second shaft that passes through channels of the third block and the fourth block;

a first linkage that couples the first restraint assembly with the second restraint assembly; and a second linkage that couples the first restraint assembly with the second restraint assembly, wherein the first shaft and the second shaft each pass through the first linkage and the second linkage, wherein the continuous first structural member is a beam and the continuous second structural member is a column, and wherein the first block and the third block each cause pressure to be applied to the beam, and the second block and the fourth block each cause pressure to be applied to the column.

2. The connector of claim 1, wherein the second restraint assembly is configured to be located diagonally across the joint intersection from the first restraint assembly.

3. The connector of claim 1, wherein the first restraint assembly further includes a first clamp module configured to apply pressure to an external side of each of the first linkage and the second linkage.

4. The connector of claim 3, wherein the first clamp module passes through a cavity of each of the first block and the second block.

5. The connector of claim 4, wherein at least a portion of the cavity of the first block is located between a channel of the first block and the first continuous beam, and wherein at least a portion of the cavity of the second block is located between a channel of the second block and the continuous second structural member.

6. The connector of claim 3, wherein the second restraint assembly further includes a second clamp module configured to apply pressure to an external side of each of the first linkage and the second linkage.

7. The connector of claim 1, wherein the first column block is configured to contact an exterior of the continuous second structural member.

8. The connector of claim 7, wherein the fourth block is configured to contact the exterior of the continuous second structural member opposite the second block.

9. The connector of claim 1, wherein the first restraint assembly includes a first insert configured for placement in between the continuous first structural member and the first block.

10. The connector of claim 1, wherein the first restraint assembly includes a second insert configured for placement in between the continuous second structural member and the second block.

11. The connector of claim 1, wherein the first linkage comprises one of a fixed-length linkage or a variable-length linkage.

12. A method for installing a rolling block restraint connector for forming a moment resisting connection at a joint intersection between a continuous first structural member and at least a continuous second structural member located adjacent to the continuous first structural member, the connector comprising:

placing a first restraint assembly at the joint intersection, wherein the first restraint assembly includes (i) a first block, (ii) a second block, and (iii) a first shaft that passes through channels of the first block and the second block;

placing a second restraint assembly at the joint intersection, wherein the second restraint assembly includes (i) a third block, (ii) a fourth block, and (iii) a second shaft that passes through channels of the third block and the fourth block; and coupling the first restraint assembly with the second restraint assembly via a first linkage and a second linkage, wherein the first shaft and the second shaft each pass through the first linkage and the second linkage, wherein the continuous first structural member is a beam and the continuous second structural member is a column, and wherein the first block and the third block each cause pressure to be applied to the beam, and the second block and the fourth block each cause pressure to be applied to the column.

13. The method of claim 12, wherein the second restraint assembly is configured to be located diagonally across the joint intersection from the first restraint assembly.

14. The method of claim 12, wherein the first restraint assembly further includes a first clamp module configured to apply pressure to an external side of each of the first linkage and the second linkage.

15. The method of claim 14, wherein the first clamp module passes through a cavity of each of the first block and the second block.

16. The method of claim 15, wherein at least a portion of the cavity of the first block is located between a channel of the first block and the continuous first structural member, and wherein at least a portion of the cavity of the second block is located between a channel of the second block and the continuous second structural member.

17. The method of claim 14, wherein the second restraint assembly further includes a second clamp module configured to apply pressure to an external side of each of the first linkage and the second linkage.

18. The method of claim 14, wherein the first linkage comprises one of a fixed-length linkage or a variable-length linkage.

* * * * *